US007698823B1

(12) United States Patent
Iadarola

(10) Patent No.: US 7,698,823 B1
(45) Date of Patent: Apr. 20, 2010

(54) WRIST STRAP ARRANGEMENTS FOR MANUAL SHAVING DEVICES

(76) Inventor: Carol Ann Iadarola, P.O. Box 159, Analomink, PA (US) 18320

( * ) Notice: Subject to any disclaimer, the term of this patent is extended or adjusted under 35 U.S.C. 154(b) by 259 days.

(21) Appl. No.: 11/064,321

(22) Filed: Feb. 23, 2005

(51) Int. Cl.
*B26B 21/40* (2006.01)

(52) U.S. Cl. ..... 30/537; 30/296.1; 30/298

(58) Field of Classification Search ..... 30/537, 30/526, 296.1, 298, 50; D28/46
See application file for complete search history.

(56) References Cited

U.S. PATENT DOCUMENTS 414,547 A * 11/1889 Kampfe ..... 30/32
471,107 A * 3/1892 Dunn ..... 606/126
2,583,057 A 1/1952 Leatherman
2,962,197 A 11/1960 Spangler, Jr.
3,111,757 A 11/1963 Dubofsky
D259,065 S * 4/1981 Byrne ..... D28/46
D269,915 S * 7/1983 Iten et al. ..... D28/46
4,624,276 A * 11/1986 Allen ..... 135/25.4
4,741,103 A * 5/1988 Hultman ..... 30/34.2
5,046,253 A * 9/1991 Ireland ..... 30/289
5,131,151 A * 7/1992 Agase et al. ..... 30/327
5,568,689 A * 10/1996 Gold ..... 30/295
5,839,198 A * 11/1998 McCoy ..... 30/537
5,944,032 A 8/1999 Masterson
5,974,916 A * 11/1999 Lassiter ..... 81/121.1
D431,095 S * 9/2000 Hyman ..... D28/45
6,112,421 A * 9/2000 Greene ..... 30/526
7,197,827 B2 * 4/2007 Paquette ..... 30/526
7,328,714 B2 * 2/2008 Wu ..... 135/15.1
2002/0062568 A1 5/2002 Stiles
2003/0084573 A1 5/2003 Kludjian et al.
2003/0208910 A1 * 11/2003 Dudley et al. ..... 30/314
2003/0208914 A1 11/2003 Ehrlich
2004/0068879 A1 4/2004 Dassel
2005/0193564 A1 * 9/2005 Trbovich, Jr. ..... 30/115

* cited by examiner

*Primary Examiner*—Hwei-Siu C Payer
(74) *Attorney, Agent, or Firm*—Clinton H. Wilkinson; Charles A. Wilkinson

(57) ABSTRACT

A wrist strap arrangement is provided for an attachment to a manual shaving device to guard against dropping of such razor. The wrist strap is designed to either by temporarily storable in the razor while not required or being used or to be conveniently removable from such razor during non-use by various attachment and storage arrangements.

17 Claims, 10 Drawing Sheets

WRIST STRAP ARRANGEMENTS FOR MANUAL SHAVING DEVICES

BACKGROUND OF THE INVENTION

1. Field of the Invention

The present invention relates to manual shaving devices in general, and more particularly to devices to prevent slipping or dropping of such shaving devices during use, and more particularly still to manual shaving devices used in combination with a safety strap or wrist loop attachment.

2. Preliminary Discussion

Manual shaving devices, which group includes safety razors, razors having disposable razor cartridges detachably connected to a reusable handle, and razors wherein the entire razor is disposable, are in wide use today by both men and women. Such shaving devices are relatively inexpensive, easy to use, and provide generally satisfactorily shaving results. Men use such razors primarily for shaving their mustache and beard area, although a growing number of men today also manually shave other parts of their body, such as their heads, particularly if they engage in athletic activities such as swimming, or other public activities. Women also use manual shaving devices to remove hair from certain body areas such as the arms, underarms, legs, and bikini area. Most shaving activities are carried out in the bathroom of a home, usually either while leaning over the washstand or in the tub or shower area, either in a standing or sitting position. First, the area to be shaved is usually wetted to add moisture to such area, after which a slippery substance such as shaving cream or soap is usually applied to such skin area. Shaving certain areas, such as the lower extremities, can require a significant amount of reaching, bending, positioning, and re-positioning one's body. This can difficult and for some physically exhausting, particularly for those who are overweight, disabled, or who have other physical limitations. Even for those who are considered physically fit, there is an increased danger of a slip and fall, primarily due to the combination of operating in a wet environment and the shaving cream or soap applied on the shaving area, which not only makes one's skin slippery, but also inevitably runs down onto the tub or shower surface, also making such surfaces slippery. In addition, shaving is generally considered an undesirable activity, and is often performed in the morning while getting ready for work or the like, or in a rush, which results in the user being relatively careless and therefore being more likely to carelessly drop the shaving device.

Operation of a manual shaving device in such a wet and slippery environment also increases the likelihood that the shaving device may accidentally slip out of the user's hand. This can happen either while the user is maneuvering his or her body into a shaving position, or also while performing such shaving activities. In general, during use, the handle of the shaving device should not be gripped too tightly, as this will decrease the user's dexterity and therefore his or her ability to control the device. For example, the cutting edge of the razor should contact the skin with only a light pressure, and should be moved over the surface of the skin in smooth, even strokes so that the blade or blades do not dig into the skin and nick or cut the user. On the other hand, gripping the handle more lightly justifiably and not unexpectedly increases the likelihood that the shaving device will be accidentally dropped. With respect to cartridge-type disposable razor shaving devices, if such device is dropped in a porcelain shower stall or tub, the impact of falling often causes the razor cartridge to disengage from the handle. Not only is it difficult sometimes to find the cartridge and then to reattach the cartridge to the handle, particularly in such a wet and slippery environment, but also the rather delicate cartridge connection mechanism on the handle, which handle is not disposable and therefore is not inexpensive, may become broken. Furthermore, reaching to pick up the cartridge further increases the danger of falling or injury, and, as indicated above, many less than agile persons may not even be able to retrieve the cartridge or razor, or at least not before it is pulled into or becomes lodged in the shower or tub drain.

3. Description of Related Art

The prior art with respect to manual shaving devices and attempts to reduce the likelihood that such devices will be dropped or slip in the hand or fingers of the user during use, has been primarily directed either to modifications to the contour of the handle section so that it is less likely to slip out of the user's hands, or to providing a non-slip coating surface or pattern such as rubber on the handle portion. While most of these attempts have been somewhat successful, they undesirably add significantly to the overall cost of such shaving devices. The following patent references are the most relevant known to the inventor, although it is not believed that any of such arrangements anticipates or renders obvious any of the embodiments of the present invention.

U.S. Pat. No. 2,583,057 issued to J. G. Leatherman on Jan. 22, 1952, entitled "Safety Razor", discloses a disposable razor having, in one embodiment, a handle made of tubular plastic conduit bent to form a narrow loop, with the ends of the conduit angled outwardly for attachment to the razor portion of the device. While such embodiment shows a safety razor having a looped handle, such loop clearly is not designed to be slipped over the user's hand as in the present inventor's arrangement.

U.S. Pat. No. 2,962,197 issued to E. L. Spangler, Jr. on Nov. 29, 1960, entitled "Electric Razor Safety Strap", discloses a safety strap for an electric razor wherein a wrist loop is integrally formed with the socket or plug portion of an electric cord where the cord detachably connects to the razor. The strap is meant to prevent dropping and breaking of expensive electrical razors, rather than manual safety razor devices, which of course do not have electrical cords. Electric razors are also subject to a further possible hazard in that the cord may become caught or entangled on an object and cause the razor to be accidentally pulled out of the hands of the user when it is moved. In addition, there is the usual danger of accidental electrical shock in a bathroom environment, where such razors are most often used, and no means for storing or disconnecting the safety strap is shown.

U.S. Pat. No. 3,111,757 issued to N. Dubofsky on Nov. 26, 1963, entitled "Balance for Safety Razors", discloses an oval body member having a socket in one end in which a manual shaving device handle is inserted and frictionally held. The body member serves as a balance for the razor handle in the users hand, making it easier to use and therefore less likely to be dropped. The body member may also be used to support the razor in a vertical position on a shelf or the like when it is not in use. The Dubofsky balance member does not, however, anticipate the safety strap arrangement of the present invention.

U.S. Pat. No. 5,944,032 issued to K. A. Masterson on Aug. 31, 1999, entitled "Squeezable Cleansing and Lathering Devices", discloses a bladder that is filled with liquid soap which is used in combination with a shower puff-type wash pad, and which further may include a looped handle or wrist cord. In one embodiment, the device has an elongated handle, which handle is open at its end so that the handle of a disposable razor can be mounted in such opening, while in another embodiment a safety razor is mounted in such end. The attached razor and looped handle arrangements are shown, however, as alternative embodiments, and a single embodiment having a razor and a looped handle is not shown. In addition, no means for detaching the looped handle or securing it in a non-use position to the handle shaft is shown.

U.S. Patent Application Publication No. 2002/0062568 filed by S. L. Stiles, entitled "Stiles Razor", discloses a razor having smaller-than-conventional razor blades wherein such blades are housed in cartridges in the razor handle. While the razor as drawn has the appearance of having a looped handle, a thorough review of the specification indicates that this is incorrect, since no mention of such an arrangement is made in the specification.

U.S. Patent Application Publication No. 2003/0208914 filed by R. W. Ehrlich, entitled "Extendable Handle Shaver", discloses a razor device having a rod and handle combination that extends the reach of the shaver 12 to 18 inches to facilitate use on otherwise hard-to-reach areas of the body, such as the back. The connecting rod is angled preferably at about 30-45 degrees, and the handle has a looped configuration, but such loop is meant to facilitate gripping of the handle in one's hand, rather than looping the handle around one's wrist.

U.S. Patent Application Publication No. 2004/0068879 filed by L. L. Dassel, entitled "Extendable Razor Handle Assembly", discloses a telescoping handle assembly for extending the reach of a conventional disposable razor or safety razor. The handle assembly also has a loop handle portion; however, Dassel indicates in the specification that the loop handle is provided to hang the assembly from a hook or the like for storage purposes, rather than to secure the razor in the hand of the user. In addition, no means for storing or detaching the loop handle is provided.

Despite the large number safety razor and disposable razor arrangements already available in the prior art, each of which is suitable for its particular purposes, as far as the present inventor is aware, there has been little attention paid to arrangements for using safety straps and wrist loops with manual shaving devices. While wrist lanyards and cords are found on a variety of goods, such as ski poles, bags, and, as shown by the Spangler, Jr. patent, electric razors, there remains a need for a convenient and inexpensive flexible safety strap arrangement for use with manual shaving devices to prevent accidental dropping of such devices during use. Such arrangement should include a means for simply and conveniently storing or holding the strap such that it is out of the way when not in use, or for detachably connecting the strap to the shaving device. The present inventor has recognized this need, and, after extensive development efforts and experimentation, has developed a manual shaving device that fulfills such need. In one preferred embodiment, a looped handle or wrist safety strap or cord that is movable between a storage position, wherein the strap is frictionally held in parallel grooves or channels provided in the exterior surface of the handle for the shaving device, and a use position wherein the strap is looped around the wrist of the user, is provided. In this arrangement, if the user does not wish to use the strap, it is not left dangling from the razor handle but rather is stored in such grooves or channels where it cannot interfere with such use. While the strap is securely held in grooves in the handle in an inoperative position in such embodiment, when it is desired to use the strap, the user can simply pry or pull it out of the grooves by applying only a relatively small amount of manual force or pressure. In another embodiment, rather than storing the strap or cord in grooves in the handle section, a clip is provided to secure the strap in an inoperative position closely adjacent the handle shaft, while in another embodiment, the safety strap or loop may be completely detached from the shaving device via several alternative clip arrangements. In yet another alternative embodiment, the strap or band may be moved between a storage position in a chamber in the shaving device handle, and a use position using a slide guide arrangement. It is believed that each of the alternative embodiments shown and disclosed provides a useful and practical solution to the problem of accidental dropping of manual shaving devices and results in a safer, less stressful, and time-saving shaving experience.

OBJECTS OF THE INVENTION

It is therefore a primary object of the invention to provide a safety strap for use with a manual shaving device to prevent accidental slippage or dropping of the shaving device during use.

It is a further object of the invention to provide a manual shaving device having a safety strap connected to the handle portion of the shaving device which strap is movable between a storage position and a use position.

It is a still further object of the invention to provide a manual shaving device having a safety strap secured to the handle section, wherein the strap is storable in at least one channel or groove integrally formed in the outer surface of such handle.

It is a still further object of the invention to provide a manual shaving device having a means for detachably connecting a safety strap to such device, which strap is secured around the wrist of the shaver during use of the shaving device to prevent accidental dropping.

It is a still further object of the invention to provide a manual shaving device having a safety strap which is storable in an internal chamber in the handle portion of such device and further which is movable in and out of such chamber using a slide button arrangement.

It is a still further object of the invention to provide a manual shaving device having a means for securing a safety strap thereto.

Still other objects and advantages of the invention will become clear upon review of the following detailed description in conjunction with the appended drawings.

SUMMARY OF THE INVENTION

A manual shaving device, such as a disposable razor, a razor having a disposable blade cartridge, or a safety razor, having a safety strap or cord attached thereto to prevent accidental dropping of such device is provided. In one preferred embodiment, the handle section of the shaving device includes a pair of parallel grooves or channels sized to receive and frictionally hold a permanently attached wrist strap or cord when it is not in use, while in another preferred embodiment, the safety strap or cord is detachably connected to the handle section of an existing shaving device by a clip means. Other alternative arrangements for storing the safety strap or cord in a chamber in the handle section and including a means for easily and quickly inserting and removing the strap to and from such chamber are also provided. In use, the safety strap or cord is looped over the hand used for manually shaving and is then secured around the wrist of such hand, with the cord being long enough so that the shaving device may be held and manipulated in such hand in a normal manner. The invention therefore provides an inexpensive and easy to use safety device for preventing accidental dropping and breaking of manual safety devices, and not only eliminates the inconvenience of having to continually reach down to pick up such device, but also helps reduce the chance of injury as a result of slipping in a wet shower or tub environment due to carelessness, accident, or physical limitation.

DESCRIPTION OF THE PREFERRED EMBODIMENTS

Figure 1:
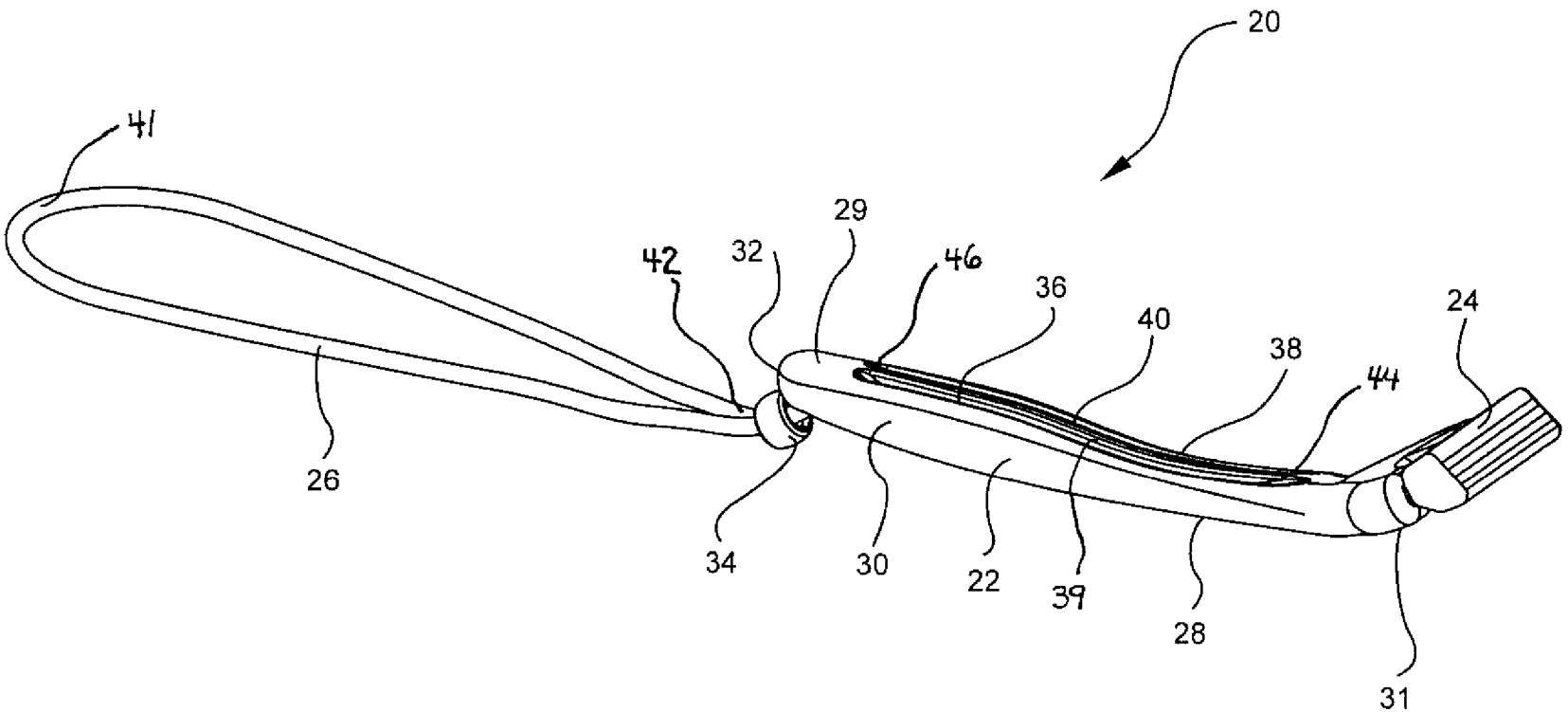
FIG. 1 is front side peeve view of a preferred embodiment of the manual shaving device of the present invention with channels or grooves on the underside of the handle facing upwardly and the safety strap disengaged in a use position.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

Reference will now be made in detail to a presently preferred embodiment of the invention as illustrated in the accompanying drawings. Whenever possible, the same reference numbers will be used throughout the drawings to refer to the same or like parts. In addition, to avoid confusion, and to aid better understanding of the invention, the terms "manual shaving device" or "manual razor shaving device" or "shaving device" or "manual razor" are used herein to refer to a shaver or razor such as a conventional disposable razor, a razor having disposable razor cartridges, or a safety razor having replaceable blades, or any device that is capable of being used as a razor that is not electrically or battery powered or operated.

FIGS. 1-4 illustrate a first preferred embodiment of the invention, FIGS. 5-8 illustrate a second preferred embodiment, while FIGS. 9-16 illustrate further alternative embodiments.

Shown in FIGS. 1-4 is a preferred embodiment of the manual shaving device 20 in accordance with the teachings of the present invention, said device being generally comprised of an elongated handle section 22, a blade section 24, and a safety strap or cord 26. Shaving device 20 is preferably a razor wherein the entire device is disposable, or wherein the blade portion 24 is a cartridge that is detachable from handle section 22 and is typically replaced with a new cartridge for use with the reusable handle portion. Handle portion 22 preferably conforms at least generally to the shape of the hand and has a top surface 28, bottom surface 29, side surfaces 30, a forward end 31, and rearward end 32. Forward end 32 is adapted to receive blade portion 24, which is generally comprised of a blade cartridge housing one or more blades in parallel, in a manner known to those skilled in the art. The ends of safety strap or cord 26 are connected along the rearward end 32 to the top surface 28 of handle portion 22, with such connection preferably being permanent in nature, and with the strap ends being inserted in apertures 48 in the handle and then secured by a suitable means such as through an adhesive, heat seal, or the like. Once secured to handle 22, strap or cord 26 forms a loop of sufficient length so that a normal sized hand can easily fit through such loop, and further so that when the shaving device is grasped in such hand, with the cord positioned around the wrist of the user, the cord should not be stretched tight or taut but should have some slack so that the normal movements of the shaving device during shaving operations are not restricted. Safety strap or cord 26 is preferably formed from a flexible plastic material such as polyethylene, although other materials such as nylon, vinyl, rubber or the like may also be used, and the strap or cord may be provided in virtually any color, combination of colors, or design. An adjustment means such as bead 34 which is slidably provided over both looped portions of the strap or cord 26 is provided to adjust the length and tightness of the strap or band around the wrist of the user, thereby preventing the cord from slipping off of the user's wrist and over the hand during use. Handle portion 22 may be molded from a more rigid plastic material, and strap or cord 26 and handle 22 may be integrally formed as a result of a single molding process, or may be formed separately and then permanently secured together by a suitable bonding process, as described above.

Figure 2:
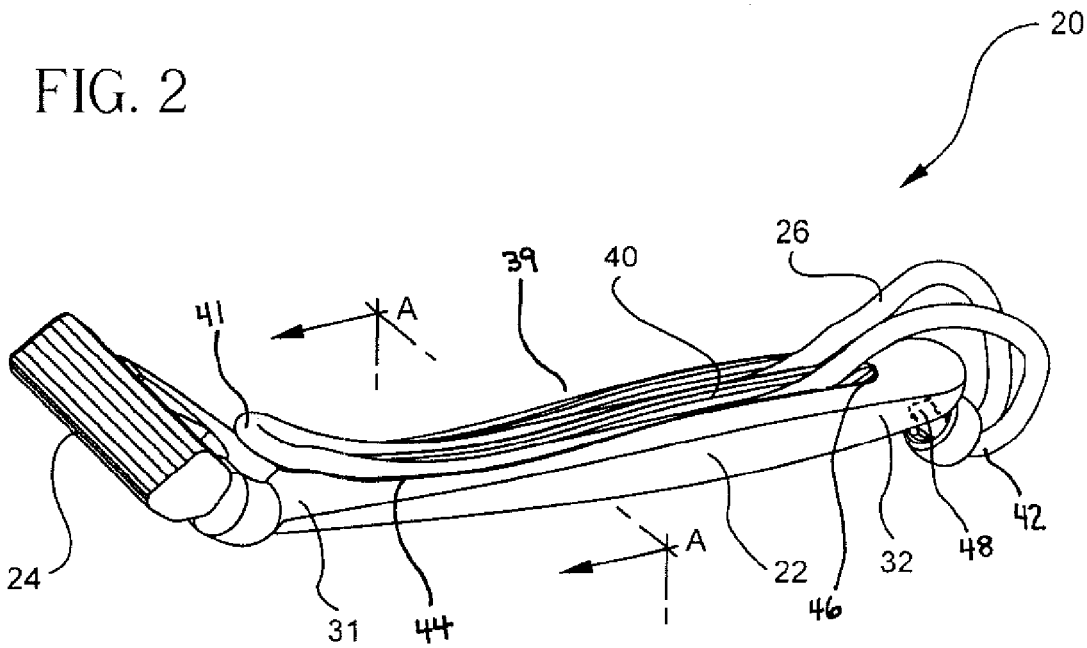
FIG. 2 is a rear side perspective view of the invention as shown in FIG. 1 with the safety strap secured in the grooves in the handle.
Figure 3:
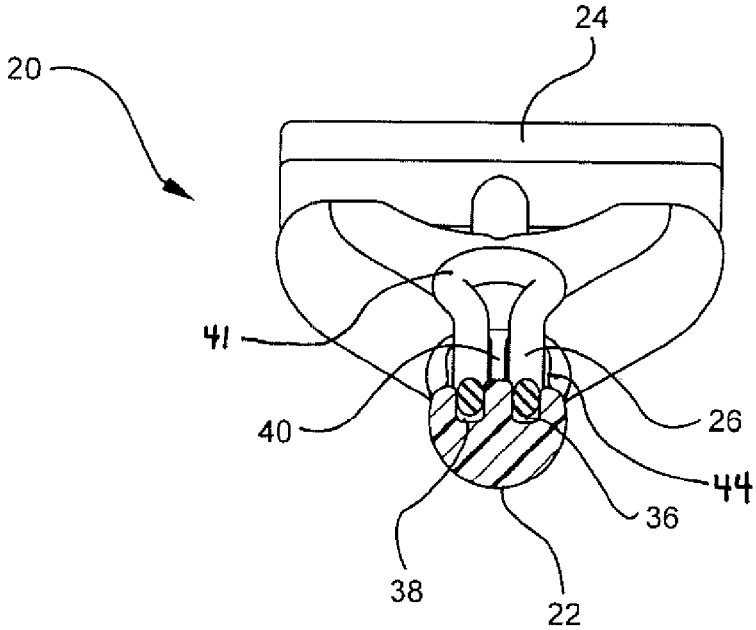
FIG. 3 is a cross-ional view of the invention taken along line A-A in FIG. 2.
Figure 4:
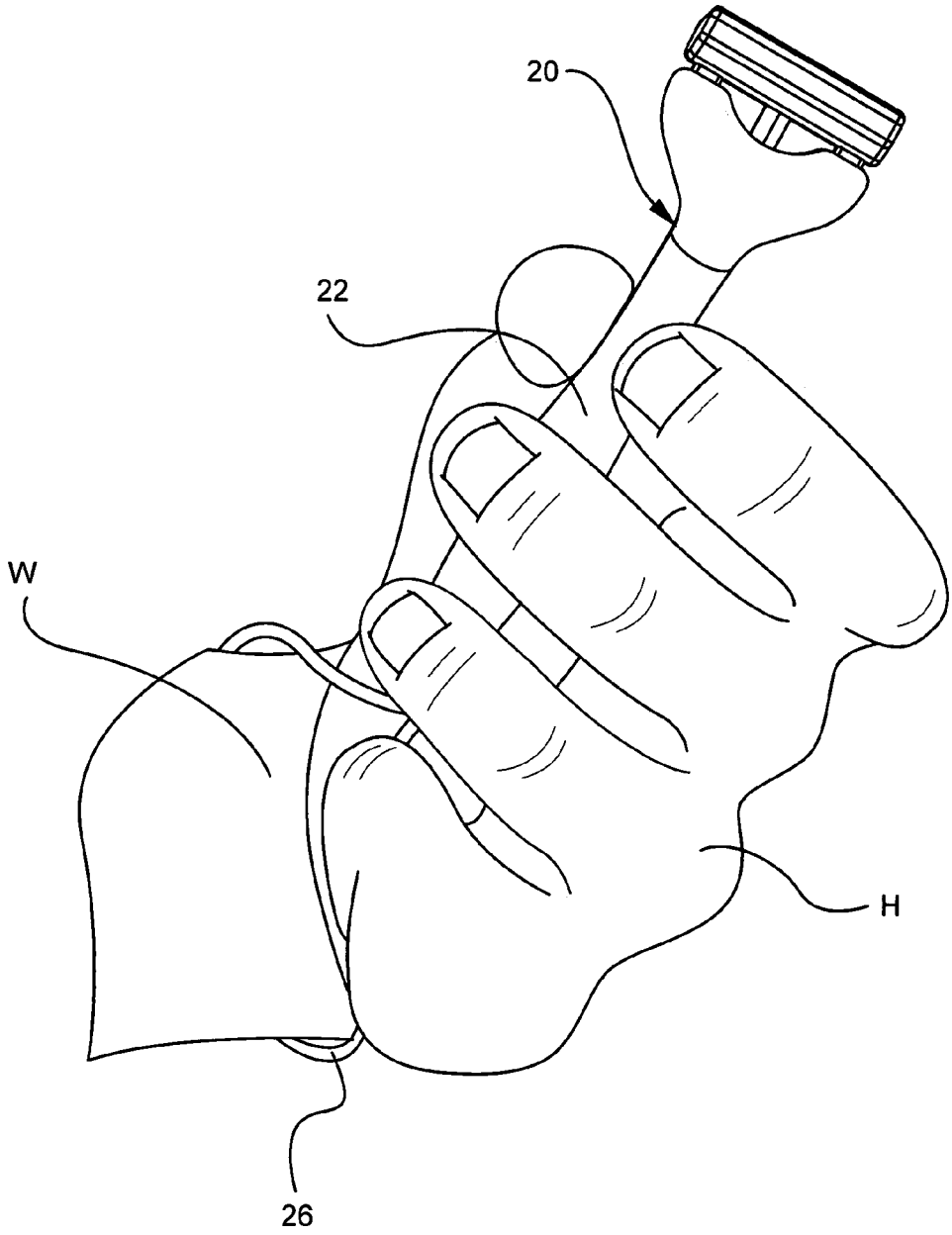
FIG. 4 is a perspective view of the manual shaving device of the invention shown in FIGS. 1-3 in use.
Figure 5:
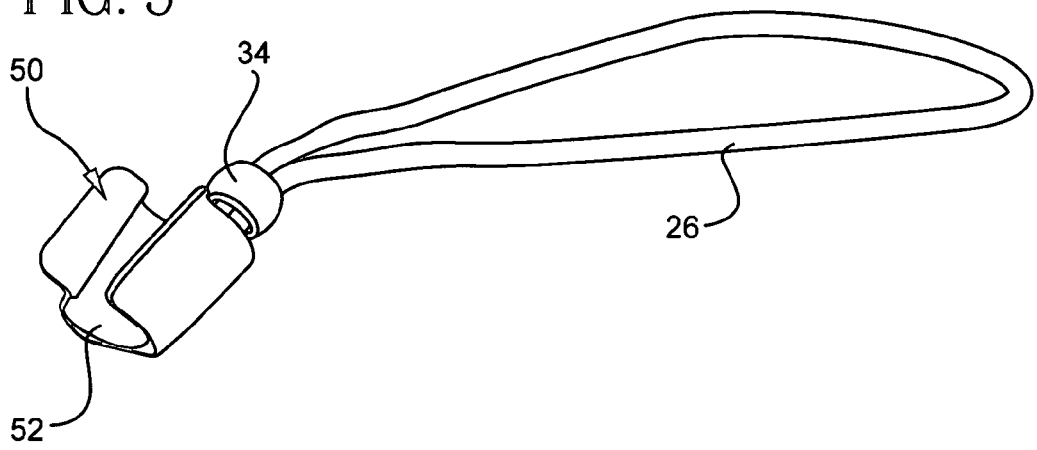
FIGS. 5 and 6 are perspective views of another preferred embodiment of the safety strap attachment device of the present invention for attachment to the handle of a manual shaving device.
Figure 6:
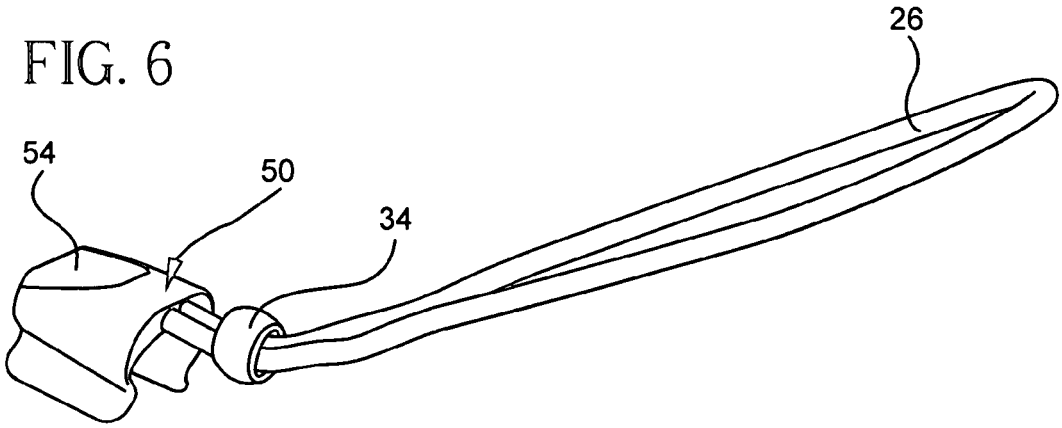
Figure 7:
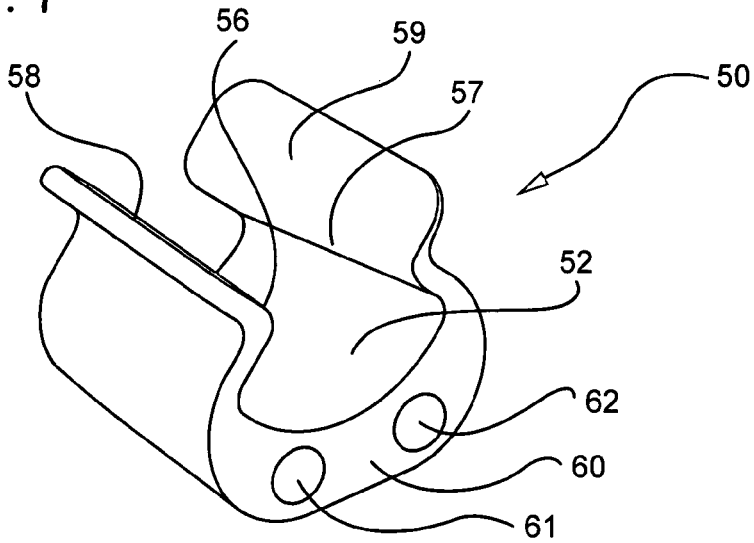
FIG. 7 is a perspective view of the clip portion of the safety strap attachment device of the invention shown in FIGS. 5-6.

Extending for a substantial distance along the bottom surface or underside 29 of handle portion 22 are pair of channels or grooves 36 and 38, separated by common wall 40, for storing wrist band or cord 26 when it is not in use. FIG. 2 illustrates shaving device 20 with cord 26 secured in channels or grooves 36 and 38, while FIG. 3 is a cross-sectional view of the device 20 taken along line A-A in FIG. 2 facing in the direction shown by the arrows channels 36 and 38 preferably have a depth that, for at least a substantial length along the midsection 39 of such channels, is slightly greater than the diameter of wrist band or cord 26. In addition, the channels 36 and 38 have a width that is slightly less than the diameter of cord 26 so that, as shown in the cross-sectional view in FIG. 3, when the loops of cord 26, which is made from a somewhat flexible material, are inserted in the channels, such loops are deformed slightly to fit in such channels and as a result are frictionally held therein. The inventor has found that it is not necessary for the entire length of cord 26 to be inserted into such channels or grooves. For example, in FIG. 2 the forward end 41-and rearward or opposite ends 42 of the loops of cord 26 are protruding from such channels, yet the strap is securely held in place. Preferably, however, at least a substantial length of the cord 26 should be secured in such channels, particularly along the midsection 39 of the channels 36 and 38 and handle 22, so that, if it is desired to use razor device 20 without releasing the cord, it will remain securely in the channels without interfering with such usage, and in addition will not protrude from the bottom side 29 of the razor handle along such midsection 39. In addition, having the forward or looped end 41 of the cord projecting out of the forward end 44 of the channels 36 and 38 as shown enables the user to quickly grasp such forward or looped end 41 and manually pull the cord 26 out of the grooves or channels 36 and 38 with only a limited amount of pulling force. As is evident from the drawings, the depth of channels 36 and 38 at forward end 44 is tapered or gradually reduced towards forward end 31 of handle section 22 so that, as shown in FIG. 2, the loops of strap 26 gradually exit such forward end 44 of the channels, and furthermore looped end 41 remains in close proximity to the forward end 31 of handle section 22 so as not to interfere with use of the razor device when the strap 26 is not in use. Similarly, as shown in FIGS. 1 and 2, the rearward end 46 of channels 36 and 38 is also slightly angled or tapered.

In use, the safety strap or cord 26 is first manually removed from grooves or channels 36 and 38 located on the underside 29 of razor handle section 22, after which the cord 26 is slipped over the hand H of the user and around his or her wrist W. See FIG. 4. As indicated above, the loop portion of safety strap 26 should be long enough to fit easily over the hand H of the user and then to allow the razor to be held in a normal shaving position in such hand. In other words, the strap cannot be so short that it does not allow the razor handle to be grasped and used in a normal manner; however, it also cannot be so long that it may easily slip off of the user's wrist and not prevent the razor device from being accidentally dropped. If a means for a tightening device is provided on the safety strap, such as bead 34 described above, such device should be tightened prior to commencing use of the razor. The user will then start using the shaving device in a normal manner, without having to worry that he or she might accidentally drop the razor, since even if the shaving device does slip out of the user's hand, the safety strap will prevent it from falling. When the shaving operation is completed, the user may then simply slip the safety strap 26 off his or her wrist, and again secure strap 26 in grooves or channels 36 and 38 on the underside of the handle. Alternatively, if desired, the safety strap may be used to hang the razor from a hook or the like at least temporarily, rather than immediately inserting it back into the channels.

While in the preferred embodiment of the invention described above with reference to FIGS. 1-4, the loop portions of wrist cord or strap 26 are secured in separate channels, both loop portions may, in a slightly alternative embodiment, be stored or secured in a single channel, wherein center wall 40 has been eliminated, and by reducing the overall width of such single channel so that it is just slightly narrower than the combined diameter of both loop portions together. Such arrangement would still enable the cord to be quickly and easily stored in the channel on the outer surface of the shaving device handle section 22, with the inner edges of the loop portions frictionally held or wedged against one other, and with the other edges of the loop portions frictionally held or engaged against the side walls of the channel. A more secure interaction between the groove and the loop will usually be obtained with two separate grooves, however, because the width of the groove and the width of the looping material may usually be more easily coordinated to provide a secure even gripping along the length of the groove. Further modifications to such means for securing the cord either as shown in FIGS. 1-4 or in a single channel, such as a providing a simple spring clip which spans the top of the channel, may also be provided, although it is believed that in almost all cases the frictional forces alone are sufficient to maintain the cord in place in such channel or channels until the cord is manually forcibly disengaged therefrom. In addition, while slightly less preferred, the forward end of the looped cord 26 may also be secured adjacent to a side section of the handle using a hook, tab, or the like. In such an arrangement, the channels or grooves are not strictly necessary, as the hook or tab rather than frictional forces between the channels and cord will be used to secure the cord in a storage position. However, it is generally believed that use of such channels reduces the likelihood that such cord will interfere with use of the manual shaving device should it ever be desired to use it without using cord 26.

While in the preferred embodiment of the invention described above the safety strap or cord 26 is permanently secured to the handle section of a manual shaving device, it may be desired to use a safety strap or cord with an already existing manual shaving device that does not include such a safety strap. Such an arrangement will now be described with reference to FIGS. 5-8 wherein a clip 50 having a safety strap or cord 26 attached with sliding tightening bead 34 is shown. Clip 50 generally has a rounded or generally cylindrical shape and includes an inner surface 52 and an outer surface 54, and is preferably made from a semi-flexible material such as polyethylene. Inner surface 52 is generally rounded or semi-cylindrical along its center section so as to match the contour or shape of the handle of a conventional manual shaving device. See FIG. 8. The curvature or shape of outer surface 54 generally follows that of inner surface 52, although from an enabling standpoint this is not strictly necessary. Clip 50 is flared or angled outwardly at 56 and 57, thereby forming flanges 58 and 59 between which there is a space or gap having a width that is slightly less than the diameter of handle portion 26 of the manual shaving device 20 on which the clip is to be fastened. On the side of clip 50 opposite flanges 58 and 59, indicated by reference numeral 60, are a pair of round orifices 61 and 62, into which the ends of cord 26 are inserted and preferably permanently secured in any suitable manner.

Figure 8:
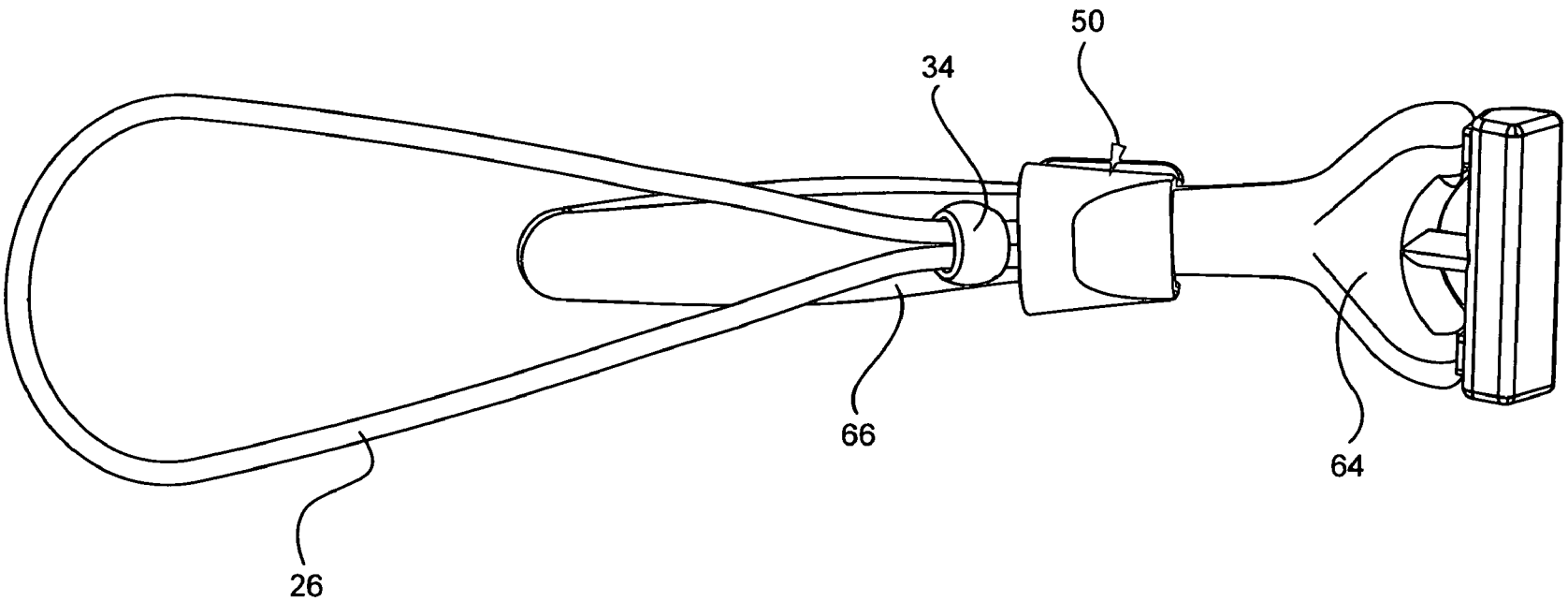
FIG. 8 is side perspective view of safety strap attachment device of the present invention shown in FIGS. 5-7 secured to the handle of a manual shaving device.

FIG. 8 illustrates clip 50 with attached cord or safety strap 26 attached in turn to the handle portion 66 of manual shaving device 64 by being clipped over the handle. Shaving device 64 is substantially the same as shaving device 20 described above, with the only difference being that safety strap or cord 26 is connected to detachable clip 50 rather than directly to handle portion 22. Clip 50 is made of an at least semi-flexible or pliable material so that when it is manually pressed or forced into engagement with handle portion 66, flanges 58 and 59 are pushed outwardly until the space or gap between outwardly angled points 56 and 57 is large enough for handle portion 66 to fit into inner section 52 of the clip, after which the clip will snap or flex around such handle. As a result, wrist loop or cord 26 is also secured to shaving device 54, after which the cord may then be secured around the wrist and tightened, and the shaving device used in the normal manner, and now without fear of dropping such shaver during use. To remove clip 50 from razor 64, it is grasped and pulled away from the handle section, which in turn will cause one or both of flanges 58 and 59 to be pushed outwardly, thereby again enlarging the gap or space between such flanges and allowing clip 50 to be slipped off of such handle portion 66. It will be understood of course that the particular dimensions and shape of clip 50 may be customized to fit manual shaving devices having handles with an unusual or unorthodox shape or dimensions. For example, clip 50 may be slightly narrower on one end than the other end, or its inner surface may have a more rectangular shape than that shown in FIG. 7.

Figure 9:
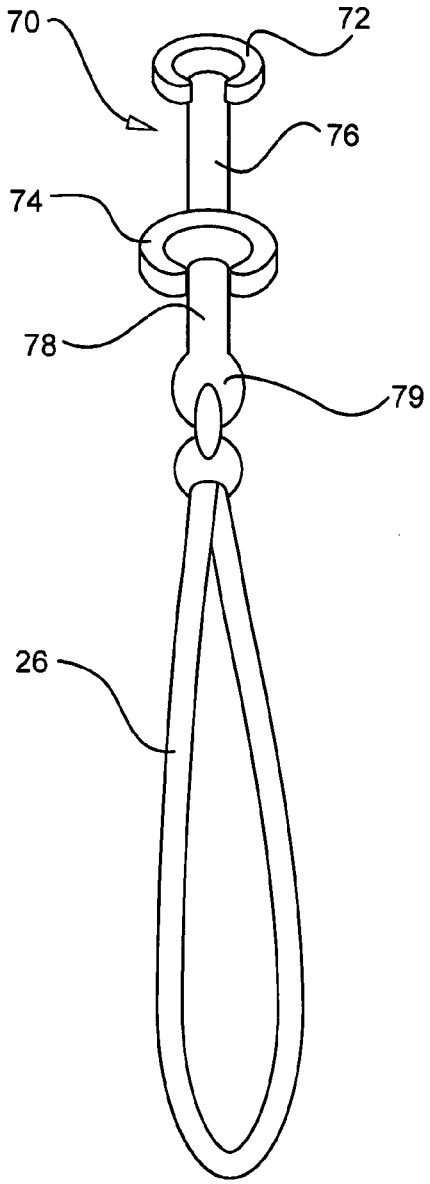
FIG. 9 is a side elevation of another safety strap attachment device of the present invention.
Figure 10:
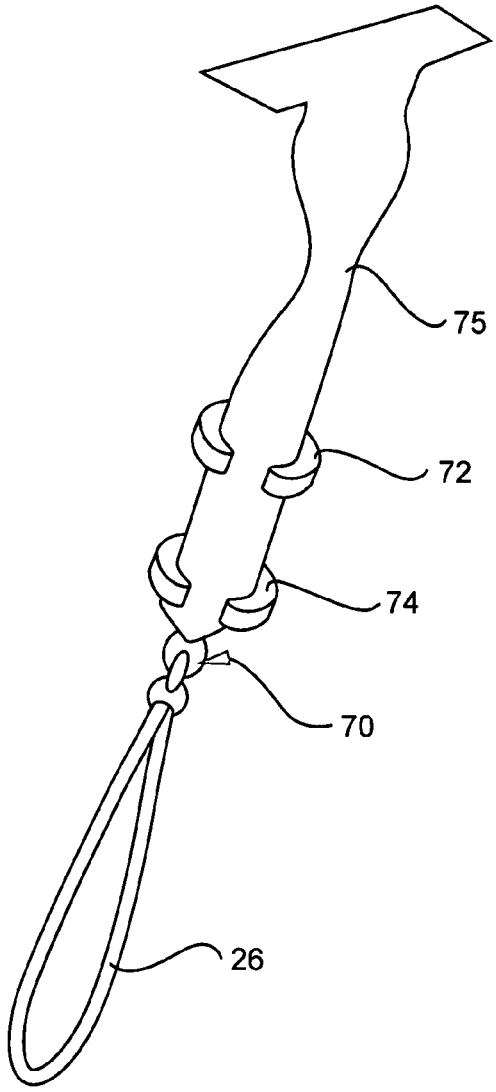
FIG. 10 is a view of the safety strap attachment device shown in FIG. 10 secured to a manual shaving device.

As another example, FIGS. 9 and 10 illustrate an alternative clip device 70, wherein rather than having a single clip portion, such clip is comprised of a pair of spaced apart individual clips 72 and 74 which are connected by a short bar section 76. Upper clip 72 as shown in FIG. 9 is slightly smaller than lower clip 74, which is an attempt to accommodate the dimensions of manual shaving devices with handles having a smaller diameter neck portion and a larger diameter body portion. Extending rearwardly from lower clip 74 is a second short bar section 78, which section 78 has an enlarged head 79 to which wrist strap or cord 26 is permanently connected. As shown in FIG. 10, when upper and lower clips 72 and 74 are pressed against the handle portion of a manual razor or shaving device 75, the clips will expand slightly to allow the handle to slip between the clips, after which the handle will be engaged in such clips by frictional contact. The clip embodiments of the invention shown in FIGS. 5 through 10 are designed to be sold separately from the razors with which they are used, or could be sold in a unitary package such as one of the clips being included with a package of disposable plastic razors.

Figure 11:
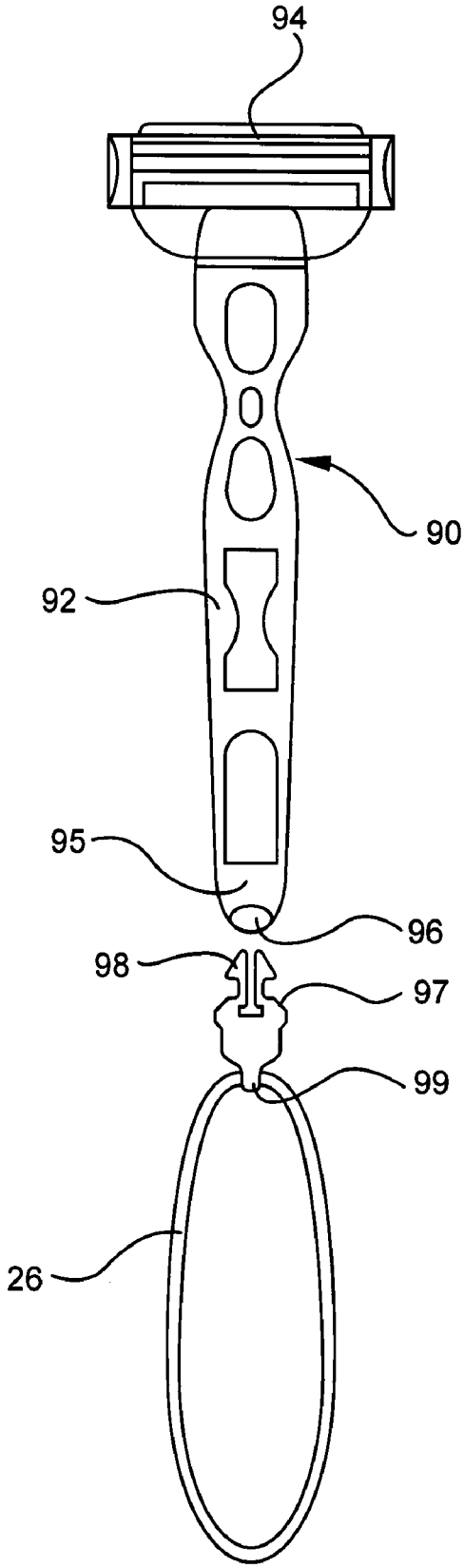
FIG. 11 is an elevation view of another alternative embodiment of the safety strap attachment device of the present invention.

FIG. 11 illustrates another alternative embodiment of the present invention wherein manual shaving device 90 having a handle section 92 and a razor section 94 is provided, and wherein in addition a male/female connection means is provided for detachably connecting wrist band or strap 26 to handle section 92. Such connection arrangement includes a female connector 96, which is situated on the rearward tip or end 95 of handle portion 92, and a matching male connector 97, which includes a pair of spaced apart angled spikes or prongs 98 that when passing into female connector 96 are biased or urged inwardly towards one another, and once fully inserted into female connector 96 flex outwardly to secure the connectors together. Situated on the other end of male connector 97 is loop 99 through which wrist safety strap or lanyard 26 is threaded and held thereto. When it is desired to use manual shaving device 90 with strap 26 attached, such strap is simply connected to the handle via connecting pair 96 and 97 as just described, after which strap 26 is looped over the user's hand and tightened around his or her wrist, after which such shaving device is ready for use in the normal manner without fear of dropping such device. The surface of handle section 90 may be provided with a rubber coating or gripping means of a known type to provide a non-slippery gripping surface.

Figure 12:
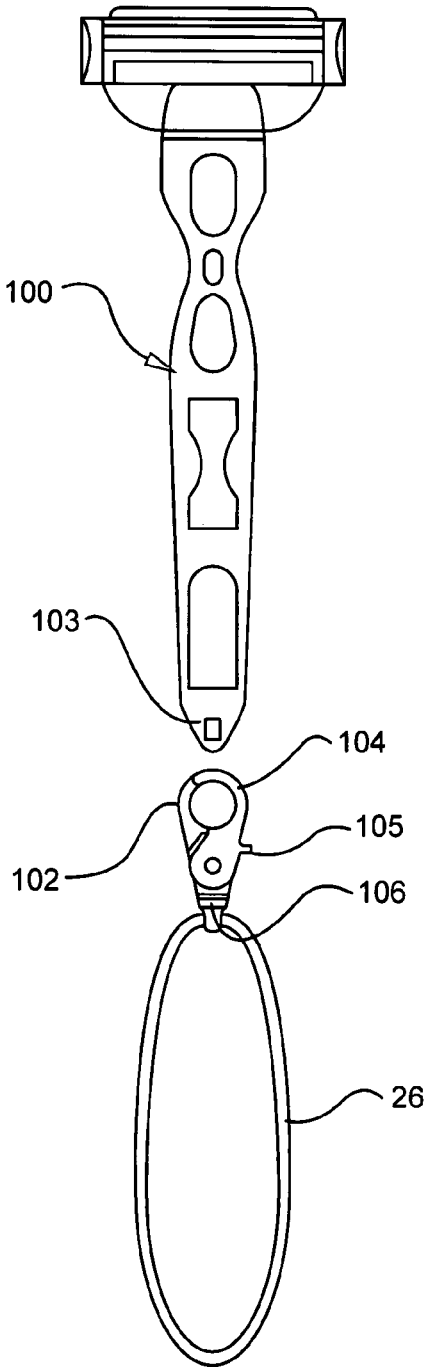
FIG. 12 is an elevation view of another alternative embodiment of the safety strap attachment device of the present invention.

FIG. 12 illustrates another alternative embodiment of the broad invention of having a removable or retractable wrist strap or cord 26, rather than being connected to the handle of the razor device 100 via snap-type connectors 96 and 97 as shown in FIG. 11, is detachably connected to the handle via a simple metal clasp 102 that is detachably secured to a loop 103 on the rearward end of the razor handle. Clasp 102 is of a conventional type known in the prior art and is provided with a latch 104 having a handle 105 which when pressed opens the latch and allows the clasp to disconnected or separated from loop 103 and shaving device 100. Strap 26 is permanently connected to the opposite end of the clasp 102, preferably via ring 106 which is preferably rotatably connected to the clasp. The attachment is of a type which will not come loose during shaving, particularly when used in a tub or the like.

Figure 13:
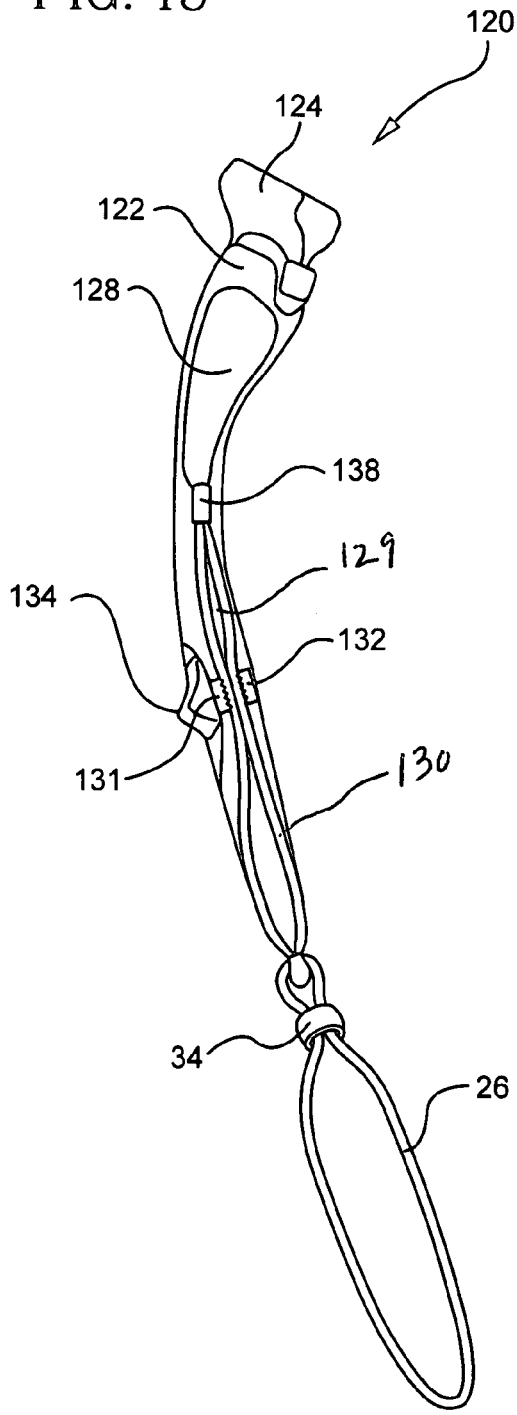
FIG. 13 is a side elevation view of an alternative embodiment of the manual shaving device of the present invention.

FIG. 13 illustrates another embodiment of the present invention, wherein the wrist strap is storable in an internal chamber in the handle portion of a manual shaving device 110, and wherein a first button on the outer surface of the handle is pressed to release the strap so that is may be manually pulled or drawn out of the chamber whenever it is desired to use such strap, and is slid back into position when it is desired to manually push the strap back into the internal chamber in the handle. In FIG. 13, manual shaving device 120 is shown having a handle section 122 and a razor blade section 124 which is pivotably connected to the forward end 126 of the handle section 122. Also provided in forward end 126 of the handle is an internal chamber 128, in which chamber, as explained below, excess length of wrist strap or cord is stored. Internal chamber 128 continues from the forward end 126 of handle section 122 towards the middle section of such handle, and gradually narrows to form narrow internal channel 129 which extends from top chamber 128 downwardly through the remaining length of handle section 122, ending at the rearward end of such handle. Strap or cord section 130 is situated substantially in channel 129, where it extends between toothed members 131 and 132 which are situated generally in the middle section or area of handle 122. Slide button 134 is provided adjacent toothed member 131 and is arranged with a bevel, not shown, so that when such button is moved or slid in one direction, it forces toothed member 131 to move inwardly, eventually pinning or holding cord section 130 between toothed members 131 and 132 and preventing such cord section 130 from further movement until such button is released. Wrist cord 26 is secured to the outer end of cord section 130, and adjustable bead 34 is again provided to tighten the looped cord around the wrist of the user as described with reference to the previous embodiments. Such arrangement enables the length of wrist cord 26 in relation to razor handle 122 to be adjusted a certain additionally length or distance if desired, by adjusting the position of cord section 130.

After the manual shaving device 120 has been used, cord section 130 and wrist cord 126 may be pulled upwardly into channel 129, with the excess cord collecting in chamber 128, through the use of collection button 138. First, slide button 134 is moved upwardly, which releases cord section 130 from between toothed members 131 and 132. Collection button 138 provides a smooth upper or outer on the cord section which allow such sections to be pushed upwardly back into handle section 122 a desired distance. In another embodiment, cord section 130 may be attached to sliding button which is slidable in a sleeve along a substantial length of the handle, so that when such button is manually moved towards the rearward end of the handle, the cord will be moved out of the internal chamber, and when the button is manually moved upwardly in such sleeve, the cord will be pulled back into the channel.

Figure 14:
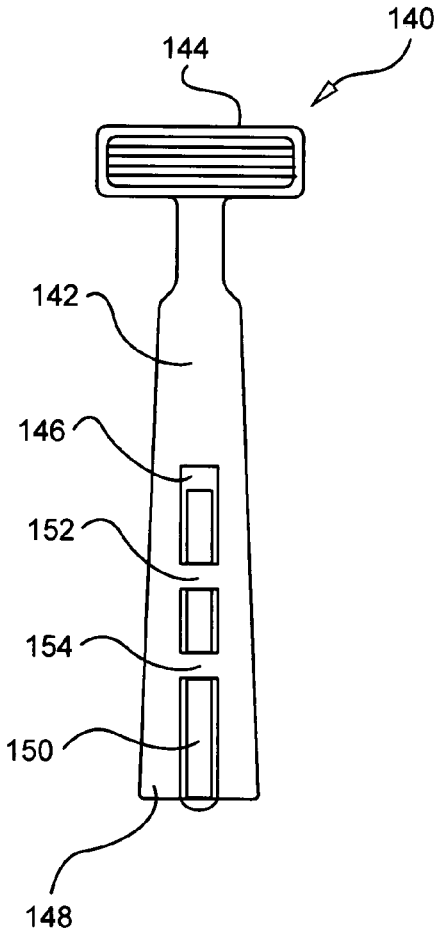
FIG. 14 is a front elevation view of another alternative embodiment of the manual shaving device of the present invention.
Figure 15:
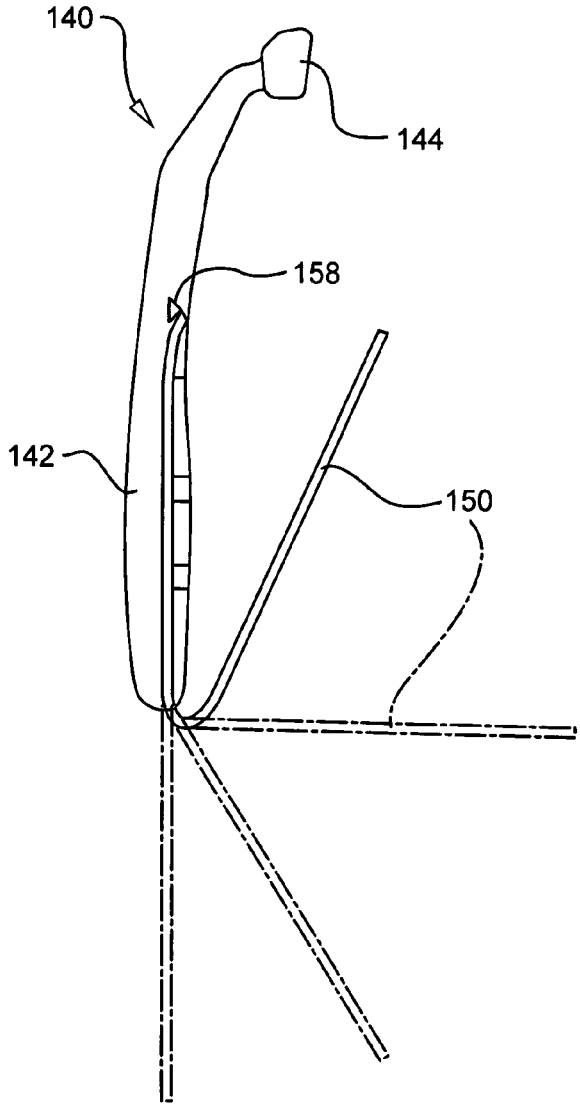
FIG. 15 is a side elevation view of the embodiment of the manual shaving device of the present invention shown in FIG. 14 also showing the internal safety strap attachment arrangement thereof.

FIGS. 14 and 15 illustrate a further alternative embodiment of the manual shaving device and wrist safety strap and cord arrangement of the present invention, comprised of shaving device 140, which device may be generally described as another manual disposable or reusable razor having a handle section 142 and a razor section 144 which is attached to the forward end of such handle section. In addition, an internal channel 146 is provided within handle section 142 extending inwardly from the rearward end 148 of handle section 142. As shown in FIG. 14, which is a front view of manual shaving device 140, wrist band 150 is provided in channel 146, with cross-pieces 152 and 154 extending across channel 146 to maintain band 150 in such channel. FIG. 14, which is a side view of shaving device 140 with a portion of the side wall of the device removed to show wrist band 150 in channel 146, and in addition showing hook 158 which is provided near the upper end of channel 146 and which is used to secure the end of wrist band 150 in such channel. In use, a length of wrist band 150 is pulled out of or removed from channel 146, after which is may be secured around the wrist of the user in the manner described above with reference to the previously described embodiments. When use is completed the wrist band may be discarded or may be folded back into the chamber 146. Alternatively, a new dry strap may be inserted or pushed up into the handle and hooked or engaged with the hook 158 at the top of the channel 146.

Figure 16:
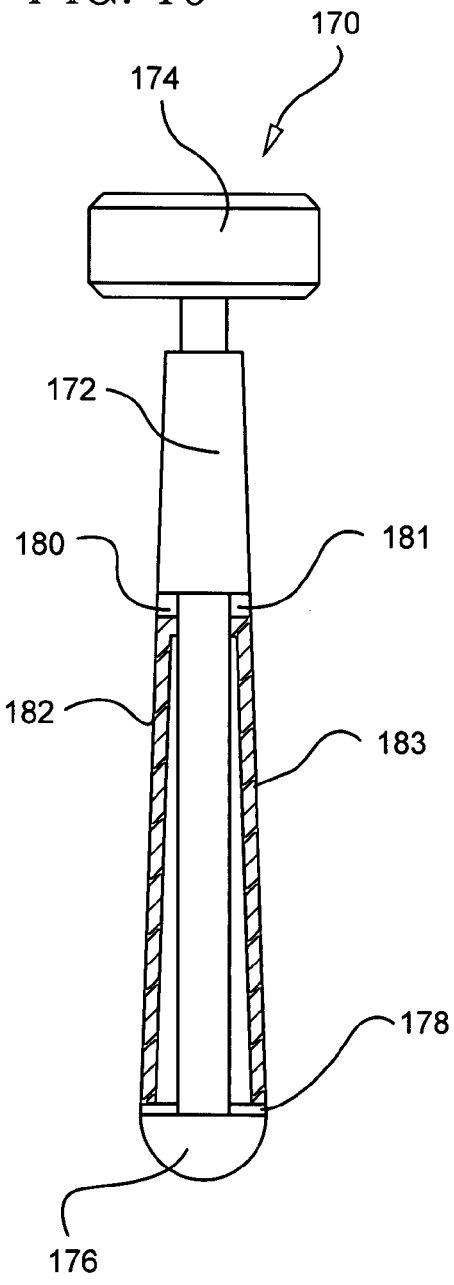
FIG. 16 is a front elevation view of yet another alternative embodiment of the manual shaving device of the present invention showing a different internal storage arrangement for a safety strap with such strap shown housed therein.
Figure 17:
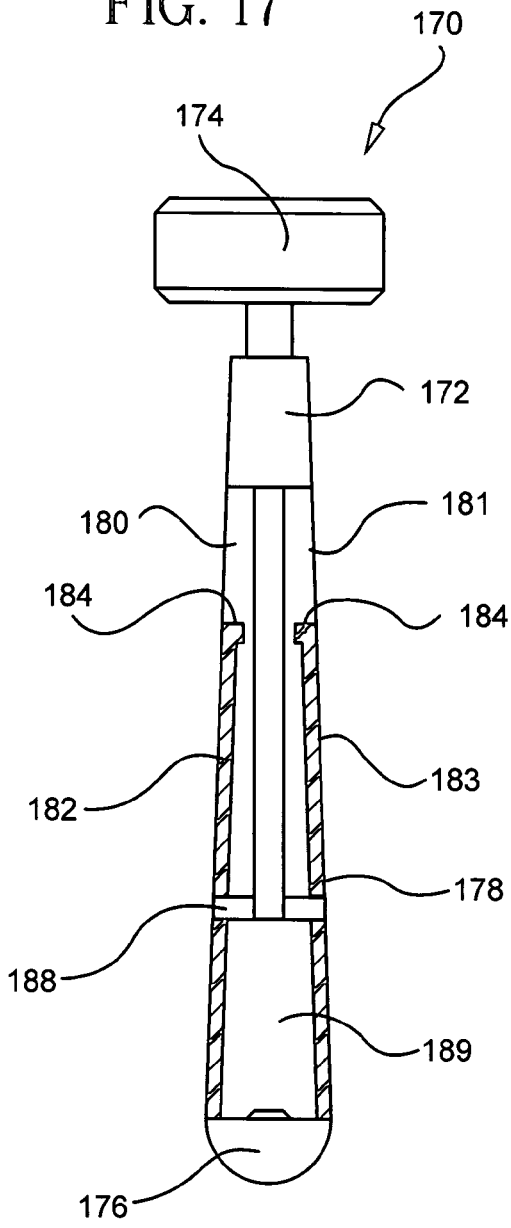
FIG. 17 is a front elevation view of the embodiment shown in FIG. 16 except with the safety strap shown partially removed from such internal storage area.

FIGS. 16 and 17 illustrate another alternative embodiment of the manual shaving device of the invention in the form of razor device 170 having a handle section 172 and razor blade section 174, and in addition having a detachable end cap piece 176 on the lower end 178 of handle section 172, which end cap piece preferably snaps onto the end of such handle section in a manner known to those skilled in the art. A pair of channels 180 and 181 are provided in handle section 172 extending upwardly from lower end 178 a substantial distance into the body of such handle. As shown in FIGS. 16 and 17, channels 180 and 181 are sized to receive the length of flexible wrist straps or bands 182 and 183. The upper ends of bands 182 and 183 are provided with laterally extending tabs 184, while the lower ends of bands 182 and 183 are secured to end cap piece 176. Alternatively, bands 182 and 183 may be comprised of a single band or strap that is attached to end cap piece 176 at substantially its midpoint so as to form the resulting loop arrangement.

It should be evident from FIGS. 16 and 17 that the purpose of such arrangement is to provide a wrist strap or band for shaving device 170 that, as shown in FIG. 16, is storable in channels 180 and 181 in handle section 172, and as a result is essentially a variation of the embodiment shown in FIGS. 1-4 wherein the wrist strap is stored in channels that are accessible along the outer surface of such handle section, rather than from lower end 178 as shown here. In FIG. 16, the wrist band 182 and 183 is completely enclosed in handle section 172, while in FIG. 17, wrist band 182 and 183 is shown partially removed or pulled from handle section 172. More particularly, in FIG. 17, end cap piece 176 is manually released from the lower end 178 of handle section 172, and then is pulled downwardly away from shaving device 170, which in turn causes bands 182 and 183 to also be pulled downwardly in channels 180 and 181, respectively. Such movement is continued until substantially the entire length of bands 182 and 183 has been pulled out of the channels; however, tabs 184 on the upper end of bands 182 and 183 will prevent such bands from being pulled out of the handle section entirely, as ledges or detents 188 along the lower end 178 of the channels are positioned so as to obstruct such tabs from being pulled out of the channels. The user may then insert his or her hand between the band sections 182 and 183 or into space or loop 189 formed between the lower end 178 of handle section 172, bands 182 and 183, and end cap piece 176 and place such loop over his or her wrist. The razor may then be used in the usual manner, with the band and end cap forming a wrist band or strap similar to the previous embodiments to prevent accidental dropping of the shaving device 170 during use. After all shaving operations have been completed, the bands are removed from the wrist by looping them back over the hand, after which the bands may be pushed back into channels 180 and 181 and end cap piece 176 once again inserted partially into or upon and jam secured to the lower end 178 of the handle section 172. Shaving device 170 therefore comprises another convenient arrangement for storing a wrist strap or band in the handle section of such device when it is not in use.

A further very convenient arrangement for attaching a wrist loop to a hand razor in the general manner shown in FIG. 11 is to form a ball or hemisphere on one end of the fitting on the loop or band, which hemisphere can then be inserted into a matching resilient hemispherical opening in the end of the handle of the razor where it is retained until forcefully removed to remove the band for storage of the razor or attachment of a new band.

One particularly useful feature of the embodiments of the invention just the described is that should the user wish to utilize the razor without using the safety strap, the manner in which the strap is secured to or in the handle section or can be removed from such handle section keeps such strap out of the way so that it does not interfere with normal shaving operations, or, alternatively the strap may simply be detached from the shaving device in the embodiments of the present invention where the strap is not permanently connected to the handle section. Thus, the present arrangement allows the user to select whether or not he or she wishes to use the safety strap, and if not, it is not a nuisance or inconvenience to the user. For example, a man when shaving his beard may not feel it is necessary to use the strap, particularly if such shaving operation is taking place while leaning over a washstand rather than while in the shower or tub area. However, if the user is in addition shaving other skin areas, such as the scalp, legs, arms, chest, or the like, or if shaving in the shower where there is an increased likelihood of slipping or dropping the razor, it likely will be desired to use the safety strap. Therefore, the unique means for moving the safety strip between a storage position and a use position easily and simply is a significant advantage of the invention.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A manual shaving device comprising:

an elongated handle section, said handle section having an upper end and a lower end;

a razor blade section operably attachable to the upper end of said handle section;

a flexible wrist strap having a looped end portion and a pair of opposite ends attachable to said handle section adjacent to one another; and a pair of parallel channels provided in an outer surface of the handle section and extending parallel to a longitudinal axis of the handle section, said channels being adapted to frictionally engage substantial portions of the wrist strap when in a storage position, not including the looped end portion or the opposite ends, each channel having a midsection and forward and rearward end sections adjacent said midsection, with the midsections having a depth slightly greater than a diameter of the wrist strap, and the forward sections having a depth that gradually decreases toward the upper end of the handle section.

2. The manual shaving device of claim 1 wherein said device is disposable.

3. The manual shaving device of claim 1 wherein said razor blade section is comprised of a disposable razor cartridge that is replaceable with a new cartridge, and wherein said handle section is reusable.

4. The manual shaving device of claim 1 additionally comprising an aperture in the lower end of said handle section in which the opposite ends of the wrist strap are inserted to facilitate securing said wrist strap to said handle section.

5. The manual shaving device of claim 1 additionally comprising a slidable adjustment member secured to said wrist strap to adjust the length and tightness of the strap when looped around the wrist of a user.

6. The manual shaving device of claim 1 wherein the handle section is comprised of a molded plastic material.

7. The manual shaving device of claim 1 in which said wrist strap is made from a deformable material, and the channels have a width that is slightly less than a diameter of said wrist strap, such that when the wrist strap is moved into a storage position, the portions of the wrist strap inserted in the channels are deformed slightly to fit in such channels and as a result are frictionally held therein.

8. The manual shaving device of claim 7 wherein when the wrist strap is secured in said channels, the looped end portion of the wrist strap projects out of the end of the forward end sections of said channels and due to said gradual decrease in depth of said forward end sections the looped end portion is maintained in close proximity to the outer surface of the handle section so as not to interfere with use of said manual shaving device when the wrist strap is in the storage position, which looped end portion can be quickly grasped to manually release the strap from the channels with only a limited amount of pulling force.

9. The manual shaving device of claim 8 in which the handle section additionally has a top surface and a bottom surface, and the channels are provided on the bottom surface of said handle section.

10. The manual shaving device of claim 9 in which the wrist strap is secured to the top side of the handle section at its lower end.

11. The manual shaving device of claim 10 in which the depth of the rearward sections of the channels gradually decreases toward the lower end of the handle section, whereby the looped end portion and portions immediately adjacent the opposite ends of the wrist strap extend out of the forward end sections and the rearward end sections of said channels, respectively.

12. A manual shaving device comprising:

a handle section, said handle section having an upper end and a lower end;

a razor blade section operably attachable to the upper end of said handle section;

a wrist strap attached to the lower end to said handle section; and a channel arrangement for storing the wrist strap in said handle section designed to provide a frictional engagement with the wrist strap, and comprised of a pair of longitudinally extending channels provided on an outer surface of said handle section, each channel being adapted to frictionally receive a portion of said wrist strap and including a midsection and forward and rearward end sections adjacent said midsection on both sides, wherein the depth of the channels in the end sections is gradually reduced toward the upper and lower ends of the handle section.

13. The manual shaving device of claim 12 wherein said device is disposable.

14. The manual shaving device of claim 12 wherein said razor blade section is comprised of a disposable razor cartridge that is replaceable with a new cartridge, and wherein said handle section is reusable.

15. The manual shaving device of claim 12 additionally comprising an aperture in the lower end of said handle section for securing the wrist strap to said handle section.

16. The manual shaving device of claim 12 additionally comprising a slidable adjustment member secured to said wrist strap to adjust the length and tightness of the strap when looped around the wrist of a user.

17. The manual shaving device of claim 12 in which the handle section and wrist strap are comprised of a molded plastic material and are integrally formed by a molding process.

* * * * *